US007841053B1

(12) United States Patent
Kali

(10) Patent No.: US 7,841,053 B1
(45) Date of Patent: Nov. 30, 2010

(54) SLIP RESISTANT CORDAGE

(76) Inventor: Damon K. Kali, P.O. Box 60187, Sunnyvale, CA (US) 94088

( * ) Notice: Subject to any disclaimer, the term of this patent is extended or adjusted under 35 U.S.C. 154(b) by 0 days.

(21) Appl. No.: 12/538,728

(22) Filed: Aug. 10, 2009

Related U.S. Application Data

(63) Continuation of application No. 12/473,873, filed on May 28, 2009.

(51) Int. Cl.
*A43C 9/00* (2006.01)

(52) U.S. Cl. ..... 24/713; 24/712

(58) Field of Classification Search ..... None
See application file for complete search history.

(56) References Cited

U.S. PATENT DOCUMENTS 1,066,759 A * 7/1913 Schloss ..... 87/2
2,306,515 A * 12/1942 Wright ..... 24/713
3,110,945 A * 11/1963 Howe, Jr. ..... 24/713
3,522,637 A * 8/1970 Brumlik ..... 24/445
4,198,734 A * 4/1980 Brumlik ..... 24/449
4,247,967 A * 2/1981 Swinton ..... 24/713
5,074,013 A * 12/1991 Arnold et al. ..... 24/713
6,212,743 B1 * 4/2001 Cohen ..... 24/713
7,549,201 B2 * 6/2009 Kraft et al. ..... 24/713

* cited by examiner

*Primary Examiner*—Jack W. Lavinder
(74) *Attorney, Agent, or Firm*—Kali Law Group, P.C.

(57) ABSTRACT

Slip resistant cordage is presented including: a length of cordage; a knot keeper configured for providing a more secure knot tied in the length of cordage, the knot keeper including: a number of branches radiating from a portion of the length of cordage, and a number of branch keepers, where each of the number of branch keepers is disposed along each of the number of branches for use in retaining the number of branches with the length of cordage. In some embodiments, slip resistant cordage is presented where the number of branches includes: a flat tip, a rounded tip, a pointed tip, a hooked tip, a barbed tip, a bull-nose tip, a bull-nose barb tip, a rectangular tip, and a rectangular barb tip.

18 Claims, 4 Drawing Sheets

SLIP RESISTANT CORDAGE

CROSS REFERENCE TO RELATED APPLICATIONS

The present invention is a continuation-in-part of the following application, all of which is incorporated herein by reference:

application Ser. No. 12/473,873 entitled "KNOT KEEPER," filed on May 28, 2009 herewith by the same inventor herein.

BACKGROUND

The use of polymeric compounds such as nylon and polypropylene in the manufacture of cordage has resulted in rot and abrasion resistant products. Indeed, when properly stored, cordage manufactured from polymeric compounds may last indefinitely. One characteristic—abrasion resistance—may be highly desirable in many applications. Abrasion resistance is partially a result of low friction characteristics typical of polymeric compounds utilized to manufacture cordage. However, the same low friction characteristics which provide abrasion resistance, may also contribute to knot slippage since the security of many kinds of knots is dependent on friction.

Attempts to overcome this problem include, treating strands of cordage chemically to increase friction between cordage surfaces; and providing clamping devices to secure cordage ends. However, chemically treating strands of cordage to increase friction may, in some instances, lower abrasion resistance. In other instances, chemical treatment may not be lasting and may "wear" off of the cordage over time. Additionally, clamping devices, while effective in some examples, provide additional complexity in securing systems. In some examples, clamping devices may even damage cordage.

As such, slip resistant cordage embodiments are provided herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, slip resistant cordage is presented including: a length of cordage; a knot keeper configured for providing a more secure knot tied in the length of cordage, the knot keeper including: a number of branches radiating from a portion of the length of cordage, and a number of branch keepers, where each of the number of branch keepers is disposed along each of the number of branches for use in retaining the number of branches with the length of cordage. In some embodiments, slip resistant cordage is presented where the number of branches includes: a flat tip, a rounded tip, a pointed tip, a hooked tip, a barbed tip, a bull-nose tip, a bull-nose barb tip, a rectangular tip, and a rectangular barb tip. In some embodiments, slip resistant cordage is presented where the number of branches extends from the length of cordage in a range of approximately 0.1 R to 2R, where R=a radius of the length of cordage. In some embodiments, slip resistant cordage is presented where the number of branches radiates from the length of cordage at an angle in a range of approximately 10 to 170 degrees. In some embodiments, slip resistant cordage is presented where the length of cordage is constructed in a configuration including: a hollow braid, a solid braid, and a twisted rope. In some embodiments, slip resistant cordage is presented where the length of cordage is manufactured from a material including: a polymeric compound, a combination of polymeric compounds, a natural fiber, and a combination of polymeric compound and natural fiber. In some embodiments, slip resistant cordage is presented where the knot keeper is manufactured from a material selected from the group consisting of: a polymeric compound, a combination of polymeric compounds, a natural fiber, and a combination of polymeric compound and natural fiber. In some embodiments, slip resistant cordage is presented where the number of branches is spaced to achieve a density in a range of approximately 1 to 20 branches per inch. In some embodiments, slip resistant cordage is presented where the number of branch keepers is includes: a knot, an overhand knot, a figure eight knot, a substantially planar and flexible disk, a substantially ovate sphere, and a substantially rectangular cube. In some embodiments, slip resistant cordage is presented where the portion is at least approximately 5% of the length of the cordage.

In other embodiments, slip resistant shoelaces are presented including: a length of hollow braid cordage; a knot keeper configured for providing a more secure knot tied in the length of hollow braid cordage, the knot keeper including: a number of branches radiating from at least a portion of the length of hollow braid cordage, where the portion of hollow braid cordage corresponds approximately with a location of a shoelace knot, and a number of branch keepers, where each of the number of branch keepers is disposed along each of the number of branches for use in retaining the number of branches with the length of hollow braid cordage. In some embodiments, slip resistant shoelaces are presented where the number of branches extends from the length of cordage in a range of approximately 0.1 R to 2R, where R=a radius of the length of hollow braid cordage. In some embodiments, slip resistant shoelaces are presented where the number of branches radiates from the length of hollow braid cordage at an angle in a range of approximately 10 to 170 degrees. In some embodiments, slip resistant shoelaces are presented where the number of branches is spaced to achieve a density in a range of approximately 1 to 20 branches per inch. In some embodiments, slip resistant shoelaces are presented where the length of hollow braid cordage and the knot keeper are manufactured from a material selected from the group consisting of: a polymeric compound, a combination of polymeric compounds, a natural fiber, and a combination of polymeric compound and natural fiber. In some embodiments, slip resistant shoelaces are presented where the number of branch keepers is selected from the group consisting of: a knot, an overhand knot, a figure eight knot, a substantially planar and flexible disk, a substantially ovate sphere, and a substantially rectangular cube.

In other embodiments, slip resistant shoelaces are presented including a length of hollow braid cordage; and a knot keeper configured for providing a more secure knot tied in the length of hollow braid cordage, the knot keeper including: a number of branches radiating from at least a portion of the length of hollow braid cordage, where the portion of hollow braid cordage corresponds approximately with a location of a shoelace knot, where the number of branches extends from the length of cordage in a range of approximately 0.1 R to 2R, where R=a radius of the length of hollow braid cordage, and where the number of branches is spaced to achieve a density in a range of approximately 1 to 20 branches per inch and a number of branch keepers, where each of the number of branch keepers is disposed along each of the number of branches for use in retaining the number of branches with the length of hollow braid cordage.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
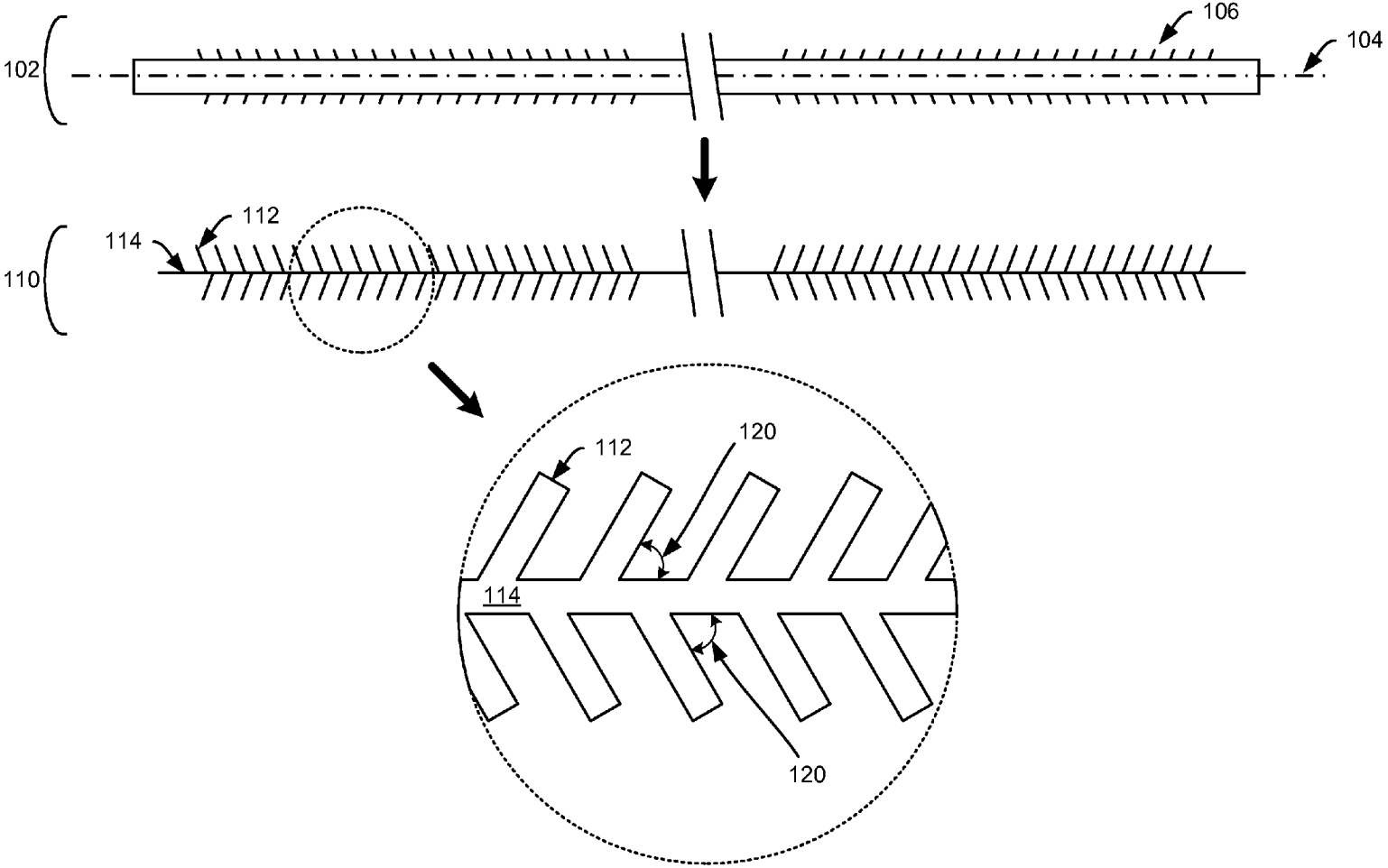
FIG. 1 is an illustrative representation of slip resistant cordage having a knot keeper in accordance with embodiments of the present invention.

FIG. 1 is an illustrative representation of slip resistant cordage 102 having a knot keeper 110 in accordance with embodiments of the present invention. In particular, the slip resistant cordage illustrated is a hollow braid cordage where a knot keeper is disposed within the cordage cavity defined by the hollow braid. In some embodiments, knot keeper may be integrated with cordage as a strand of the cordage. In addition, in embodiments, cordage and knot keeper may be manufactured from a polymeric compound, a combination of polymeric compounds, a natural fiber, and a combination of polymeric compound and natural fiber without limitation.

As illustrated, knot keeper 110 includes a trunk 114 and a plurality of branches 112. Knot keeper 110 is disposed along cordage axis 104. In some embodiments, a portion of branches 112 extends from the cordage (see 106). In some embodiments, branches 112 extend from the cordage in a range of approximately 0.1R to 1R, where R=cordage radius. Thus, in one embodiment, a total length of a branch would be R+0.1R. Further illustrated, branches 112 may radiate from trunk 114 at any angle 120 in a range of approximately 10 to 170 degrees. The angle at which a branch radiates from a trunk is application specific. For example, where more slip resistant cordage is desired, a 90° radiating angle may be utilized. Where less slip resistant cordage is desired, a much lower, or much higher radiating angle may be utilized. In embodiments, a knot keeper may be manufactured from a polymeric compound, a combination of polymeric compounds, a natural fiber, and a combination of polymeric compound and natural fiber without limitation.

Figure 2:
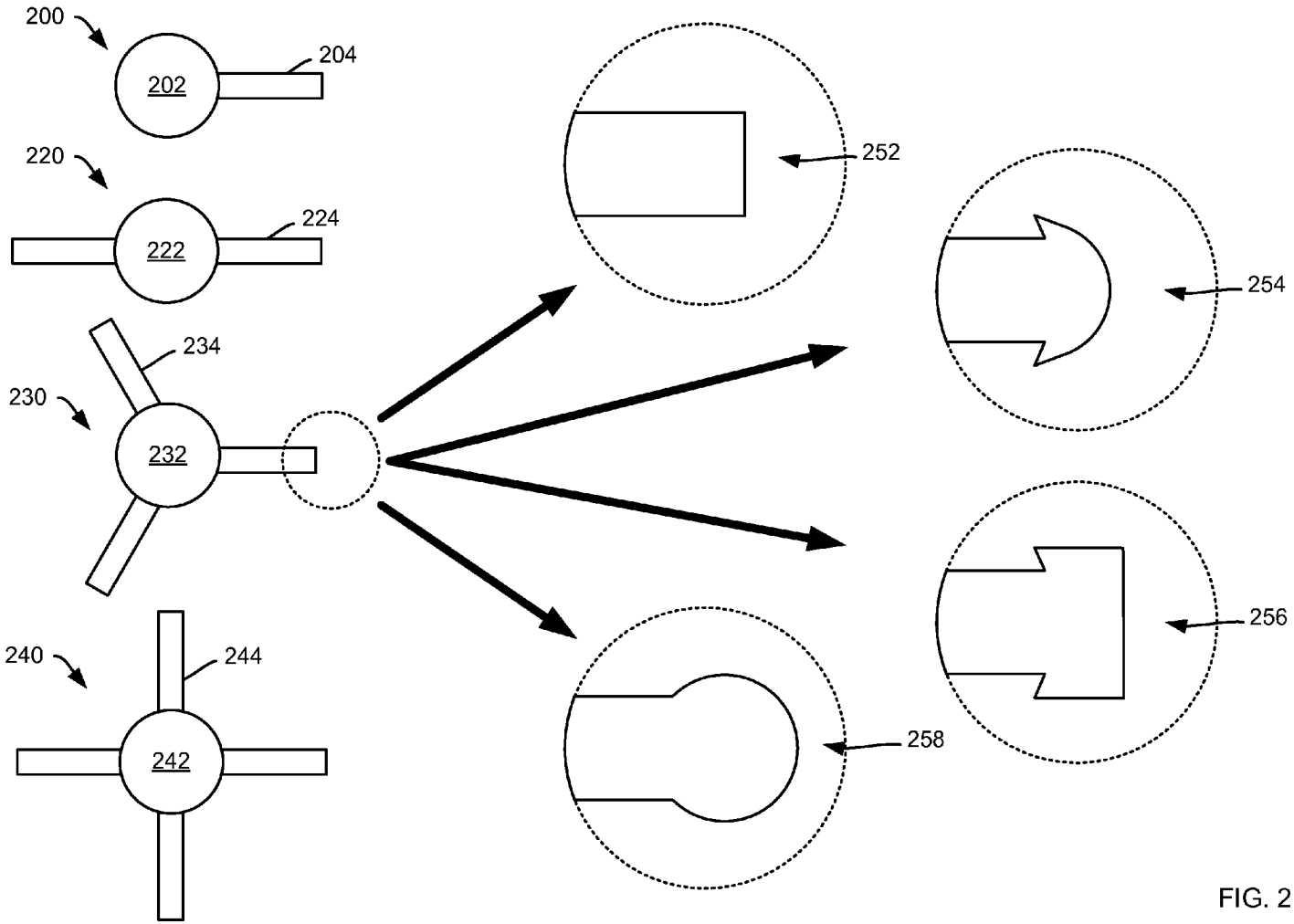
FIG. 2 is an illustrative representation of various configurations of a knot keeper in accordance with embodiments of the present invention.

FIG. 2 is an illustrative representation of various configurations of a knot keeper in accordance with embodiments of the present invention. In particular, several cross-sectional representations are presented for clarity in understanding embodiments of the present invention. For example, in embodiments, single row orientation 200 having trunk 202 and branch 204 is illustrated. Single row orientation refers to an orientation of branch rows with respect to the trunk. In this embodiment, one row is utilized. Configuration may be symmetrical with respect to orientation as well as to spacing. Thus, single row orientation may include branches which are uniformly spaced (symmetrical) or randomly spaced (asymmetrical). Further, the density of branches may vary without limitation without departing from the present invention. Thus, in some embodiments, branches may vary in density in a range of approximately 1 to 20 branches per inch without departing from the present invention.

In other embodiments, double row orientation 220 having trunk 222 and branch 224 is illustrated. Double row orientation refers to an orientation of branch rows with respect to the trunk. In this embodiment, two rows are utilized. Configuration may be symmetrical with respect to orientation as well as to spacing. Thus, while two rows are oriented at approximately 180° with respect to one another in this illustration (symmetrical), the two rows may be oriented in any configuration (asymmetrical) without limitation without departing from embodiments provided herein. Further, double row orientation may include branches which are uniformly spaced (symmetrical) or randomly spaced (asymmetrical). In addition, in embodiments, branches may directly oppose one another as illustrated, or may be offset (see 112, FIG. 1). Further, the density of branches may vary without limitation without departing from the present invention. Thus, in some embodiments, branches may vary in density in a range of approximately 1 to 20 branches per inch without departing from the present invention.

In other embodiments, triple row orientation 230 having trunk 232 and branch 234 is illustrated. Triple row orientation refers to an orientation of branch rows with respect to the trunk. In this embodiment, three rows are utilized. Configuration may be symmetrical with respect to orientation as well as to spacing. Thus, while three rows are oriented at approximately 120° with respect to one another in this illustration (symmetrical), the three rows may be oriented in any configuration (asymmetrical) without limitation without departing from embodiments provided herein. Further, triple row orientation may include branches which are uniformly spaced (symmetrical) or randomly spaced (asymmetrical). In addition, in embodiments, branches may directly oppose one another as illustrated, or may be offset (see 112, FIG. 1). Further, the density of branches may vary without limitation without departing from the present invention. Thus, in some embodiments, branches may vary in density in a range of approximately 1 to 20 branches per inch without departing from the present invention.

In other embodiments, quadruple row orientation 240 having trunk 242 and branch 244 is illustrated. Quadruple row orientation refers to an orientation of branch rows with respect to the trunk. In this embodiment, four rows are utilized. Configuration may be symmetrical with respect to orientation as well as to spacing. Thus, while four rows are oriented at approximately 90° with respect to one another in this illustration (symmetrical), the four rows may be oriented in any configuration (asymmetrical) without limitation without departing from embodiments provided herein. Further, quadruple row orientation may include branches which are uniformly spaced (symmetrical) or randomly spaced (asymmetrical). In addition, in embodiments, branches may directly oppose one another as illustrated, or may be offset (see 112, FIG. 1). Further, the density of branches may vary without limitation without departing from the present invention. Thus, in some embodiments, branches may vary in density in a range of approximately 1 to 20 branches per inch without departing from the present invention. In other embodiments, any number of row orientations may be utilized. For example, quintuple, sextuple, septuple, and octuple row orientations may be utilized without limitation. In addition, any random orientation may be utilized in some embodiments. That is, branches may be configured randomly in orientation, spacing, and density without departing from the present invention.

Also illustrated for FIG. 2, are a number of tip options. Tip options may be selected for application with a particular braid or material. Thus, in a loose braid embodiment where abrasion is a concern, a bull-nose tip 258 may be utilized. In embodiments, bull-nosed tips may be ovate or semi-ovate. In addition, where a stronger friction hold is desired, a barbed tip embodiment such as bull-nose barb tip 254 and rectangular barb tip 256 may be utilized. In embodiments, other tips may include flat tip 252, rounded tip (not shown), barbed tip (not shown), rectangular tip (not shown), hook tip (not shown), and pointed tip (not shown). As may be appreciated, tip selection may depend both upon penetration characteristics of the tip with respect to cordage being utilized and upon strand characteristics of the cordage such as strand diameter and strand friction properties.

Figure 3:
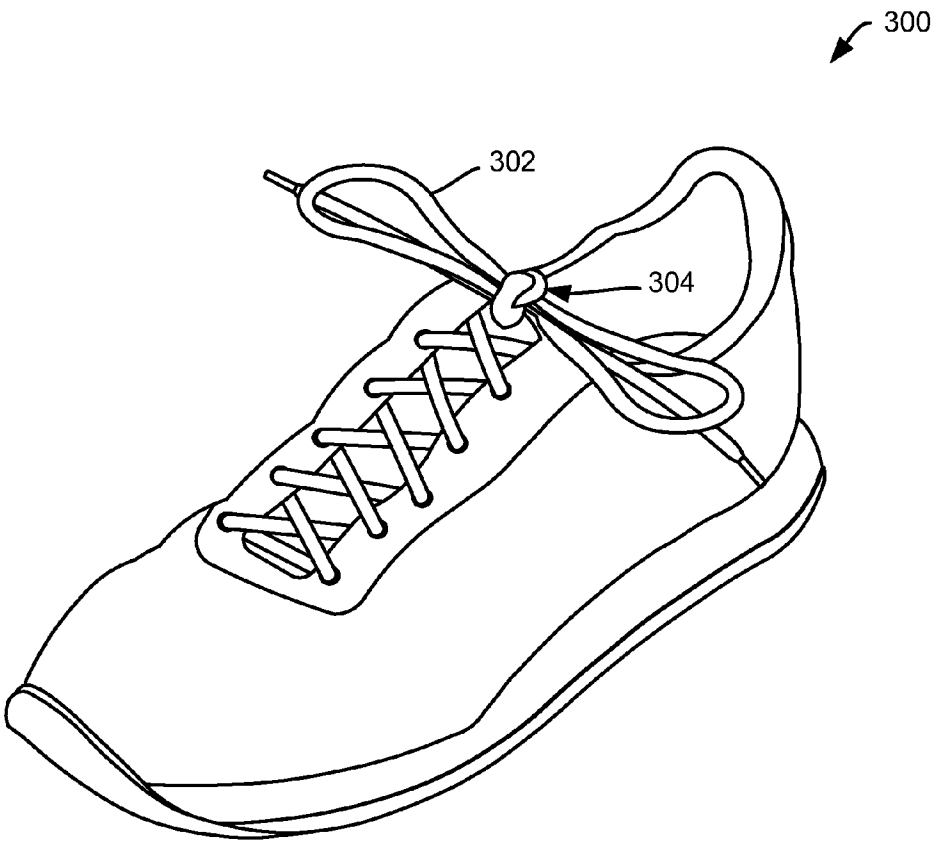
FIG. 3 is an illustrative representation of a shoe having a slip resistant shoelace in accordance with embodiments of the present invention.

FIG. 3 is an illustrative representation of a shoe 300 having a slip resistant shoelace 302 in accordance with embodiments of the present invention. As may be appreciated, knot keeper embodiments presented herein may be particularly effective in maintaining a knot in a shoelace. Modern shoelaces may be made of polymeric compounds or combinations of polymeric compounds. Manufacturers utilize these polymeric compounds, in some examples, to resist rotting. For example, anyone who has a pair of hiking boots that have only limited use, understand the frustration of retrieving their boots only to find their leather or cotton laces have rotted away to the extent they are not usable. Polymeric compounds resist rotting so that shoes only having occasional use may be readily usable on demand.

Shoelaces manufactured with polymeric compounds, however, may exhibit some knot slippage. Thus, in the hiking boot example, while the hiking boot may be usable, the constant tying and retying of a shoelace knot may lead to an undesirable user experience. Attempts to remedy this problem include clamping mechanisms of some sort, or removing the shoelace altogether and replacing it with a buckle, zipper, or VELCRO™ arrangement. A slip resistant shoelace 302 having an integrated knot keeper serves to maintain knot 304. As illustrated above for FIG. 1, knot keepers embodiments disclosed herein extend from cordage. In this example, knot keeper will extend outside of a shoelace. Shoelaces are typically composed of hollow braid cordage. As such, knot keepers may be disposed within the cavity formed by the hollow braid. The branches may extend outside the shoelace in a range of approximately 0.1R to 1R where R=radius of the shoelace. The branches then serve to penetrate and grab fibers of adjacent slip resistant shoelace cordage. In this manner, friction is increased so that the knot is maintained. Barbed and non-barbed branch tips may be utilized depending on the desired strength of the knot being tied. In addition, shaped tips may either promote or inhibit penetration depending on desired characteristics for the application at hand.

Figure 4:
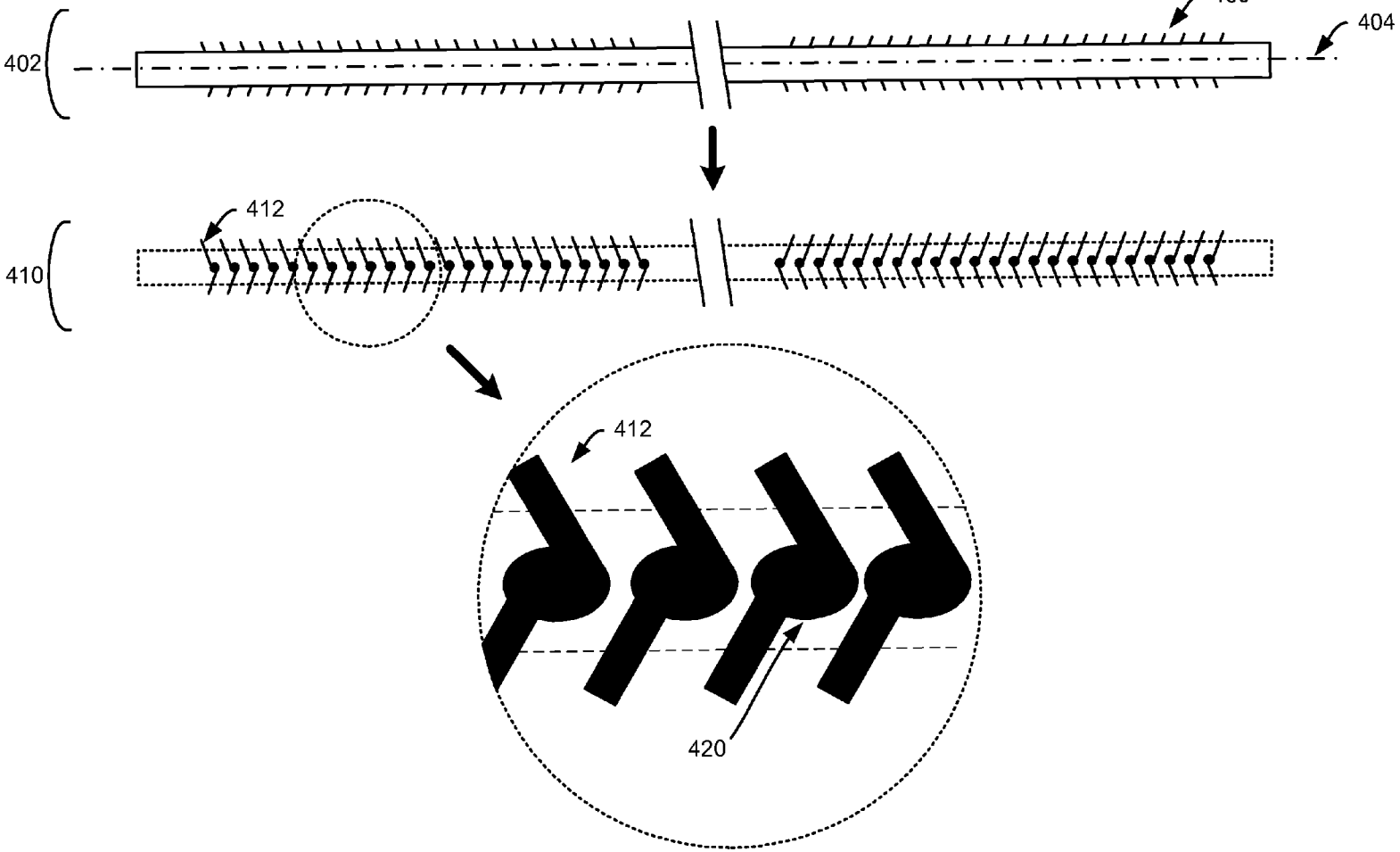
FIG. 4 is an illustrative representation of slip resistant cordage having a knot keeper in accordance with embodiments of the present invention.

FIG. 4 is an illustrative representation of slip resistant cordage 402 having a knot keeper 410 in accordance with embodiments of the present invention. In particular, the cordage illustrated is a hollow braid cordage where a knot keeper is disposed to traverse the cordage cavity defined by the hollow braid. In addition, in embodiments, cordage and knot keeper may be manufactured from a polymeric compound, a combination of polymeric compounds, a natural fiber, and a combination of polymeric compound and natural fiber without limitation.

As illustrated, knot keeper 410 includes and a plurality of branches 412. Knot keeper 410 is disposed along cordage axis 404. In some embodiments, a portion of branches 142 extends from the cordage (see 406). In some embodiments, branches 412 extend from the cordage in a range of approximately 0.1R to 2R, where R=cordage radius. Thus, in one embodiment, a total length of a branch would be 0.2R (0.1R extension)+2R (diameter of cordage)=2.2R. Further illustrated, branches 412 may radiate from cordage axis 404 at any angle in a range of approximately 10 to 170 degrees. The angle at which a branch radiates from a trunk is application specific. For example, where more slip resistant cordage is desired, a 90° radiating angle may be utilized. Where less slip resistant cordage is desired, a much lower, or much higher radiating angle may be utilized. In embodiments, a knot keeper may be manufactured from a polymeric compound, a combination of polymeric compounds, a natural fiber, and a combination of polymeric compound and natural fiber without limitation. As illustrated, each branch 412 may include a branch keeper disposed within the cordage cavity. As may be appreciated, a branch keeper may be utilized to capture the branch thus minimizing branch loss. In one embodiment, a branch keeper may be a knot, an overhand knot, a figure eight knot. In other embodiments, branch keeper may include a stopper attached with a branch such as, for example, a substantially planar and flexible disk, a substantially ovate sphere, and a substantially rectangular cube. In other embodiments, a branch keeper may include a stopper formed from the same material as the branch and attached with a branch. It may be noted that branches may be inserted into cordage along all of the cordage or along a portion of the cordage. For example, in one embodiment, branches may be inserted along a portion shoelace corresponding with a knot location. In other embodiments, the portion is at least 5% of the length of the cordage. Thus, portions not receiving a branch may remain otherwise substantially smooth.

In embodiments, a double row orientation may include branches which are uniformly spaced (symmetrical) or randomly spaced (asymmetrical). In addition, in embodiments, branches may directly oppose one another as illustrated, or may be offset (see 112, FIG. 1). Further, the density of branches may vary without limitation without departing from the present invention. Thus, in some embodiments, branches may vary in density in a range of approximately 1 to 20 branches per inch without departing from the present invention.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A slip resistant cordage comprising:

a length of cordage; and a knot keeper configured for providing a more secure knot tied in the length of cordage, the knot keeper comprising:

a plurality of branches radiating from at least a portion of the length of cordage, and a plurality of branch keepers, wherein leach of the plurality of branch keepers is disposed along each of the plurality of branches for use in retaining the plurality of branches with the length of cordage and wherein the plurality of branch keepers is selected from the group consisting of: a knot, an overhand knot, a figure eight knot, a substantially planar and flexible disk, a substantially ovate sphere, and a substantially rectangular cube.

2. The slip resistant cordage of claim 1, wherein the plurality of branches further comprises a tip selected from the group consisting of: a flat tip, a rounded tip, a pointed tip, a hooked tip, a barbed tip, a bull-nose tip, a bull-nose barb tip, a rectangular tip, and a rectangular barb tip.

3. The slip resistant cordage of claim 1, wherein the plurality of branches extends from an outer surface of the length of cordage in a range of approximately 0.1R to 2R, wherein R=a radius of the length of cordage, wherein the radius is defined from a cordage axis to the outer surface of the length of cordage.

4. The slip resistant cordage of claim 1, wherein the plurality of branches radiates from the length of cordage at an angle in a range of approximately 10 to 170 degrees.

5. The slip resistant cordage of claim 1, wherein the length of cordage is constructed in a configuration selected from the group consisting of: a hollow braid, a solid braid, and a twisted rope.

6. The slip resistant cordage of claim 1, wherein the length of cordage is manufactured from a material selected from the group consisting of: a polymeric compound, a combination of polymeric compounds, a natural fiber, and a combination of polymeric compound and natural fiber.

7. The slip resistant cordage of claim 1, wherein the knot keeper is manufactured from a material selected from the group consisting of: a polymeric compound, a combination of polymeric compounds, a natural fiber, and a combination of polymeric compound and natural fiber.

8. The slip resistant cordage of claim 1, wherein the plurality of branches is spaced to achieve a density in a range of approximately 1 to 20 branches per inch.

9. The slip resistant cordage of claim 1, wherein the length of cordage is a shoelace.

10. The slip resistant cordage of claim 9, wherein the radiating from at least the portion of the shoelace corresponds approximately with a location of a shoelace knot.

11. The slip resistant cordage of claim 10, wherein the portion is at least approximately 5% of the length of the cordage.

12. The slip resistant cordage of claim 1, wherein the plurality of branches is spaced to achieve a density in a range of approximately 1 to 20 branches per inch.

13. A slip resistant shoelace comprising:

a length of hollow braid cordage; and a knot keeper configured for providing a more secure knot tied in the length of hollow braid cordage, the knot keeper comprising:

a plurality of branches radiating from at least a portion of the length of hollow braid cordage, wherein the portion of hollow braid cordage corresponds approximately with a location of a shoelace knot, and a plurality of branch keepers, wherein each of the plurality of branch keepers is disposed along each of the plurality of branches for use in retaining the plurality of branches with the length of hollow braid cordage.

14. The slip resistant shoelace of claim 13, wherein the plurality of branches extends from the length of hollow braid cordage in a range of approximately 0.1 R to 2R, wherein R=a radius of the length of hollow braid cordage.

15. The slip resistant shoelace of claim 13, wherein the plurality of branches radiates from the length of hollow braid cordage at an angle in a range of approximately 10 to 170 degrees.

16. The slip resistant shoelace of claim 13, wherein the length of hollow braid cordage and the knot keeper are manufactured from a material selected from the group consisting of: a polymeric compound, a combination of polymeric compounds, a natural fiber, and a combination of polymeric compound and natural fiber.

17. The slip resistant shoelace of claim 13, wherein the plurality of branch keepers is selected from the group consisting of: a knot, an overhand knot, a figure eight knot, a substantially planar and flexible disk, a substantially ovate sphere, and a substantially rectangular cube.

18. A slip resistant shoelace comprising:

a length of hollow braid cordage; and a knot keeper configured for providing a more secure knot tied in the length of hollow braid cordage, the knot keeper comprising:

a plurality of branches radiating from at least a portion of the length of hollow braid cordage, wherein the portion of hollow braid cordage corresponds approximately with a location of a shoelace knot, wherein the plurality of branches extends from the length of cordage in a range of approximately 0.1R to 2R, wherein R=a radius of the length of hollow braid cordage, and wherein the plurality of branches is spaced to achieve a density in a range of approximately 1 to 20 branches per inch and a plurality of branch keepers, wherein each of the plurality of branch keepers is disposed along each of the plurality of branches for use in retaining the plurality of branches with the length of hollow braid cordage.

* * * * *